US007896316B2

(12) United States Patent
Willim

(10) Patent No.: US 7,896,316 B2
(45) Date of Patent: Mar. 1, 2011

(54) TRUCK CRANE

(75) Inventor: Hans-Dieter Willim, Ulm-Unterweiler (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 16 days.

(21) Appl. No.: 12/217,633

(22) Filed: Jul. 8, 2008

(65) Prior Publication Data

US 2009/0026426 A1 Jan. 29, 2009

(30) Foreign Application Priority Data

Jul. 10, 2007 (DE) ..... 20 2007 009 639 U

(51) Int. Cl.
*B66D 1/00* (2006.01)

(52) U.S. Cl. ..... 254/323

(58) Field of Classification Search ..... 254/323
See application file for complete search history.

(56) References Cited

U.S. PATENT DOCUMENTS

| | | | | |
|---|---|---|---|---|
| 4,383,791 | A * | 5/1983 | King | 414/542 |
| 4,795,305 | A * | 1/1989 | Friend | 414/709 |
| 4,826,023 | A | 5/1989 | Ortemond | |
| 5,337,854 | A * | 8/1994 | Brandt | 182/2.9 |
| 5,690,240 | A * | 11/1997 | Thiermann, Sr. | 212/180 |
| 5,772,183 | A * | 6/1998 | Sears | 254/324 |
| 6,152,425 | A * | 11/2000 | Boyer | 254/323 |
| 6,494,437 | B1 * | 12/2002 | Boyer | 254/323 |
| 6,799,935 | B1 * | 10/2004 | Grollitsch | 414/546 |
| 6,948,701 | B2 * | 9/2005 | Knoerzer et al. | 254/134.3 FT |
| 6,983,927 | B2 * | 1/2006 | Pelletier et al. | 254/385 |
| 7,500,651 | B2 * | 3/2009 | Wentworth et al. | 254/323 |
| 7,530,547 | B2 * | 5/2009 | Leitner et al. | 254/323 |

FOREIGN PATENT DOCUMENTS

| | | |
|---|---|---|
| DE | 199 56 312 | 5/2001 |
| DE | 100 61 330 | 6/2002 |
| DE | 19964356 | 7/2004 |
| DE | 20 2005 016 815 | 3/2007 |
| EP | 0354167 | 2/1990 |
| EP | 1862636 | 12/2007 |
| WO | 9924348 | 5/1999 |

* cited by examiner

*Primary Examiner* — Emmanuel M Marcelo

(74) *Attorney, Agent, or Firm* — Dilworth & Barrese LLP

(57) ABSTRACT

The present invention relates to a truck crane with a winch, in particular a hoisting winch, which is mounted on the upper-carriage, wherein the truck crane includes means for raising and/or lowering the winch.

17 Claims, 4 Drawing Sheets operating position transport position

TRUCK CRANE

BACKGROUND OF THE INVENTION

The present invention relates to a truck crane with a winch mounted on an uppercarriage, in particular a hoisting winch. Such truck crane usually comprises the uppercarriage rotatably mounted on an undercarriage, wherein the winch is mounted on the rotary platform frame of the uppercarriage. Furthermore, a boom usually is mounted on the uppercarriage, which can be luffed up via hydraulic cylinders. The hoisting winch serves to actuate the hoisting cable when lifting a load. For this purpose, there can also be provided a plurality of hoisting winches.

In the working condition, the boom of the truck crane can also be strongly luffed down. In this flat position, all hoisting cables must be guided from the hoisting winches to the tip of the boom. Hence it follows that the rear winch must be positioned at a higher level. As a result, the height permitted by the Federal Motor Vehicle Safety Standards can be exceeded during transport.

Furthermore, in many known truck cranes the problem arises that the operability of the crane on the construction site can only be accomplished by means of an auxiliary crane, as additions to and modifications of the truck crane are necessary on the construction site, in order to ensure compliance with the transport regulations in terms of maximum admissible height and axle loads.

SUMMARY OF THE INVENTION

Therefore, it is the object of the present invention to provide a truck crane which complies with the transport regulations in terms of maximum admissible height and axle loads. Furthermore, it is the object of the present invention to provide a truck crane which can accomplish operability independently on many construction sites without an auxiliary crane.

In accordance with the invention, this object is solved by a truck crane according to the description herein. In accordance with the invention, the truck crane therefore includes means for raising and/or lowering the winch. As result, the truck crane of the invention can accomplish operability independently on the construction site, without the winch having to remain in its operating position during transport.

Advantageously, the winch can releasably be connectable with the truck crane, in particular to be removed for transport by the means for raising and/or lowering the winch and to be mounted again thereafter. Thus, the winch can be demounted before transport by the means for raising and/or lowering the winch, so that both the height and the weight of the truck crane of the invention are reduced correspondingly during transport. On the construction site, the winch then is mounted again. Both can be effected by the inventive means for raising and/or lowering the winch without an auxiliary crane.

Advantageously, the winch can be lifted from below into a rotary platform frame of the uppercarriage by the means for raising and/or lowering the winch. In a furthermore advantageous way, the winch can also be let down again from the rotary platform frame of the uppercarriage by the means for raising and/or lowering the winch. As a result, it is easily possible to first mount the winch on the construction site without an auxiliary crane being necessary for this purpose. In this case, the winch can be transported to the construction site e.g. by a separate transport vehicle.

In a furthermore advantageous way, the winch can, however, also be inserted into the rotary platform frame of the uppercarriage from above by means of an auxiliary crane.

This provides more flexibility during erection, as the truck crane can be upgraded both automatically via the means for raising and/or lowering the winch and via an auxiliary crane.

In a furthermore advantageous way, the winch of the invention can be moved by the means for raising and/or lowering the winch on the uppercarriage from a first position into an operating position located at a higher level with respect to the height direction of the truck crane and/or from an operating position into a first position located at a lower level with respect to the height direction of the truck crane. As a result it is possible to lower the winch upon operation, in order to maintain the maximum admissible heights of the truck crane during transport. Upon arrival at the construction site, the winch can then be raised again into its operating position. As a result, it is no longer necessary to completely demount the winch for transport. Nevertheless, operability can easily and independently be accomplished via the means for raising and/or lowering the winch.

Advantageously, the first position therefore is a transport position of the winch on the crane.

Furthermore advantageously, the first position is a further operating position, which permits an operation of the truck crane, in particular a fully adequate operation of the truck crane without ballast. In particular, the truck crane advantageously can also be used for lighter elevations, such as mounting elevations, in the transport position of the winch, so that the transport position at the same time constitutes a further, possibly restricted operating position.

Advantageously, the winch thus has three possible positions:

a) an operating position, b) a lower first position, which at the same time constitutes a transport position and a further, possibly restricted operating position, and c) winch not on the crane.

In a furthermore advantageous way, the device in accordance with the invention includes a seat for ballast, which at the same time forms the means for raising and/or lowering the winch. During operation of the crane, the ballast must be arranged on the rear part of the uppercarriage, in order to form a counterweight for the boom or the load. Before commencement of the transport ride of the truck crane, however, the ballast is removed from the uppercarriage and deposited on the undercarriage or on a separate transport vehicle, in order to comply with the axle loads of the undercarriage. A device for accommodating ballast serves such removal and accommodation of the ballast on the uppercarriage. Such device for accommodating ballast is known in particular from DE 20 2005 016 815 U1, whose contents completely form part of the present application. In accordance with the invention, such device for accommodating ballast now is used to raise and/or lower the winch.

In a furthermore advantageous way, the means for raising and/or lowering the winch comprise a pallet, which is movable in vertical direction by means of hoisting means, wherein the winch and/or the ballast can be moved into an operating position by means of the pallet. Advantageously, the winch or the ballast is arranged on the pallet and moved into the operating position by the movement of the pallet.

In a furthermore advantageous way, the pallet can be bolted to the uppercarriage in the operating position. Thus, the pallet remains on the uppercarriage during operation and serves to retain the winch or ballast.

Advantageously, the pallet includes seats, in particular adjustable seats, on which the winch can be erected and positioned in a defined way.

In the operating position, the winch advantageously rests on the pallet bolted to the uppercarriage. The pallet bolted to the uppercarriage thus serves to lock the winch in the operating position.

Advantageously, the winch can be bolted to the uppercarriage. As a result, the winch can be connected with the uppercarriage, for instance after having been raised into its operating position. Such bolting also can serve to fix the winch in the first position, in particular in a transport position.

Advantageously, bolting the winch to the uppercarriage is effected by means of an oblong hole, which allows a movement of the winch from an operating position into a first position located at a lower level with respect to the height direction of the truck crane, in particular into a transport position. Such oblong hole thus allows a certain movement of the winch on the uppercarriage and at the same time serves to lock the winch in the operating position and in the first position.

Advantageously, the winch can be locked in the first position, in particular in a transport position, in particular by means of a latch, which fixes the bolt in the oblong hole, so that the truck crane can also be operated with the winch disposed in the first position. As a result, the first position constitutes a further operating position, so that the truck crane can for instance be used to load the ballast plates or the pallet independently and without an auxiliary crane.

In the operating position, the winch furthermore advantageously is locked via the pallet bolted to the uppercarriage and via the bolting of the oblong hole. A further locking therefore is not necessary.

In a furthermore advantageous way, locking the winch in the first position is effected automatically. This can be effected by a corresponding control of a latch drive, e.g. via a spring drive with corresponding control surfaces.

In a furthermore advantageous way, the locking of the winch is released automatically when it is raised into the operating position. This can also be effected via a corresponding drive.

The present invention comprises both a truck crane with only one winch, which can be raised and/or lowered by the means for raising and/or lowering the winch, and a truck crane with two or more winches, which in accordance with the invention can be raised and/or lowered by the means for raising and/or lowering the winch. In addition, the truck cranes of the invention also can include further winches, which cannot be raised and/or lowered by the means for raising and/or lowering the winch.

BRIEF DESCRIPTION OF THE DRAWINGS

The present invention will now be explained in detail by means of an embodiment and the drawings, in which.

DESCRIPTION OF THE PREFERRED EMBODIMENTS

Figure 1A:
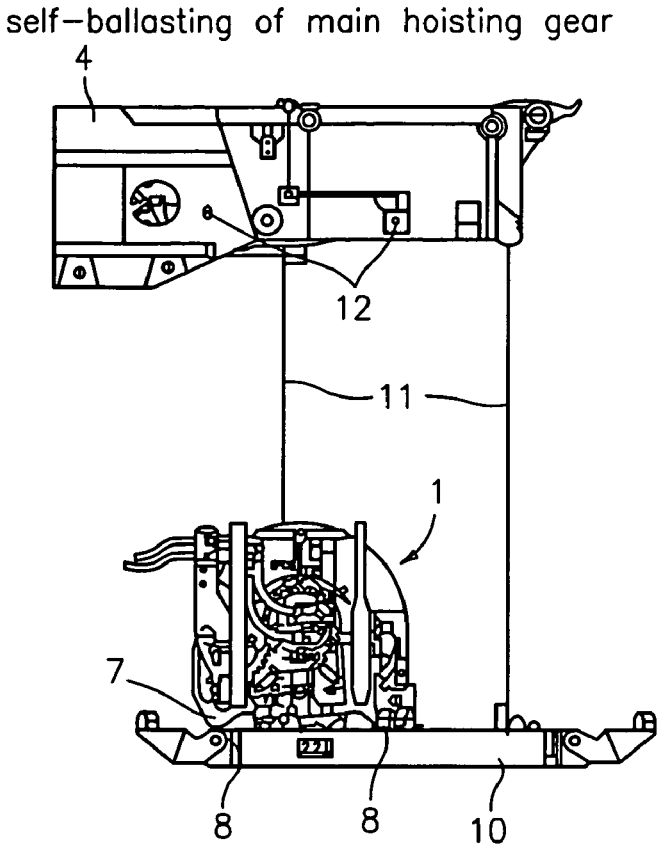
FIG. 1*a*: shows an embodiment of the means of the invention for raising and/or lowering the winch with the winch let down.
Figure 1B:
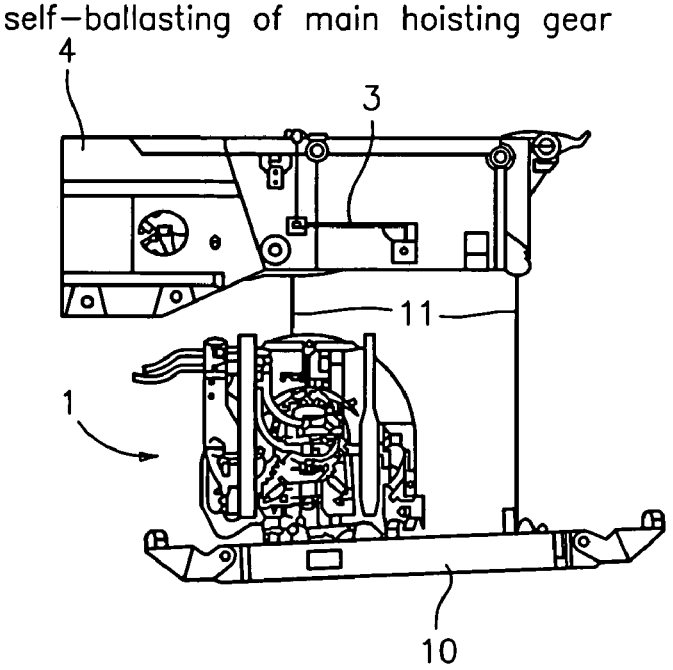
FIG. 1*b*: shows the embodiment of the means of the invention for raising and/or lowering the winch with the winch raised further as compared to FIG. 1*a*, FIG. 2*a*: shows an embodiment of the winch of the invention in an operating position.

FIGS. 1*a* and 1*b* show an embodiment of the means of the invention for raising and/or lowering the winch 1 in differently lowered positions. The means include a pallet 10, which can be pulled up and let down again via cables 11 on the rotary platform frame 4 of the uppercarriage. This arrangement also serves to accommodate the ballast, and its configuration is described in detail in DE 20 2006 007 486 U1, which is completely included herein by reference. In particular, the pallet 10 can completely be pulled up to the uppercarriage via the cables 11 and can be bolted to the same, and for demounting the winch or the ballast from the uppercarriage can either be let down to a separate transport vehicle, to the ground or to the undercarriage.

The hoisting means for actuating the cables 11 are arranged in the rotary platform frame 4 and advantageously comprise hydraulic cylinders, which are arranged substantially horizontally. In its operating position, the pallet 10 can be bolted to the rotary platform frame 4 and thereby locks the winch 1. The non-illustrated ballast also is retained at the uppercarriage via the pallet 10.

The pallet 10 now includes adjustable seats 8, on which the winch 1 can be deposited and positioned in a defined way via corresponding positioning elements 7. A further attachment of the winch 1 on the pallet 10 is not provided.

For mounting the winch 1, the same now is positioned on the pallet 10, whereupon the pallet 10 is raised from below via the cables 11 on the rotary platform frame 4. As a result, the winch 1 can be raised from below into its operating position. The pallet 10 includes tabs, by means of which it can be bolted to the rotary platform frame 4. Via bolts 6 on bolting points 12 on the rotary platform frame 4, the winch 1 also is bolted to oblong holes 9 on the winch 1 in its operating position. Before self-ballasting the winch, the bolts 6 must be unlocked to the outside at the bolting points 12 on the left and right sides of the rotary platform frame 4. After the winch has been pulled up, the bolts 6 are again locked to the inside. For this purpose, a linkage 3 is provided, which provides for operating the bolts 6 from a safe footing.

Figure 2A:
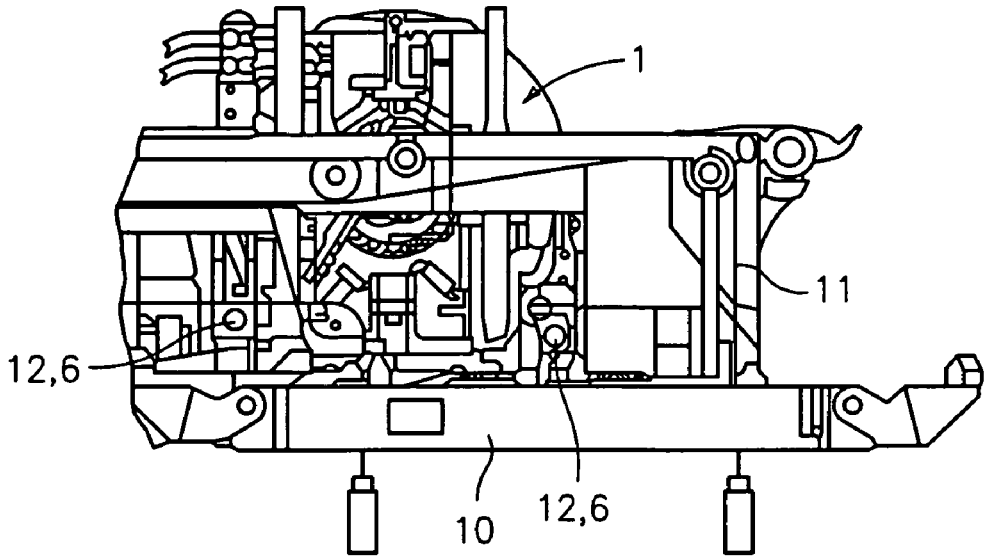
FIG. 2*b*: shows the embodiment of the winch of the invention in a transport position.

In FIG. 2*a*, the winch 1 is shown in this operating position. In downward direction, the winch 1 is fixed via the pallet 10 bolted to the rotary platform frame 4. In upward direction, and against tilting, it is locked via the bolts 6, which engage in the bolting points 12 on the rotary platform frame 4 and in the oblong holes 9 on the winch.

Figure 2B:
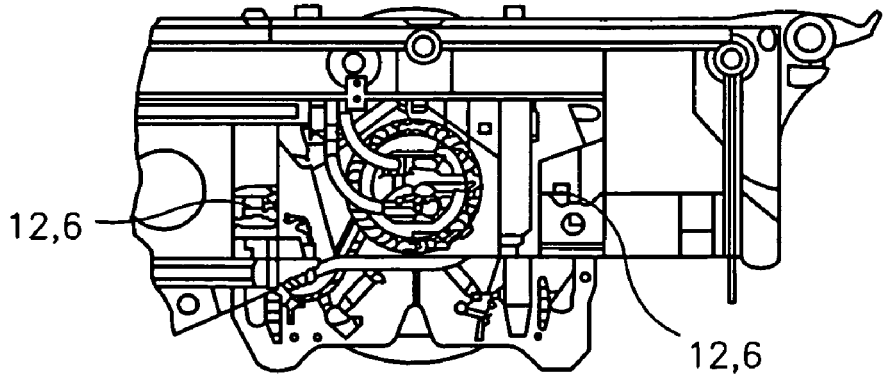

In FIG. 2*b*, on the other hand, the transport position of the winch 1 is shown, in which the pallet 10 was let down, whereas the bolts 6 still remain in place. As a result, the winch initially moves with the pallet 10 in downward direction along the oblong holes 9, until the upper ends of the oblong holes 9 abut against the bolts 6. This transport position is shown again in FIG. 3, and it can be seen that in the transport position the winch 1 has the same height as the front winch 2.

Figure 4:
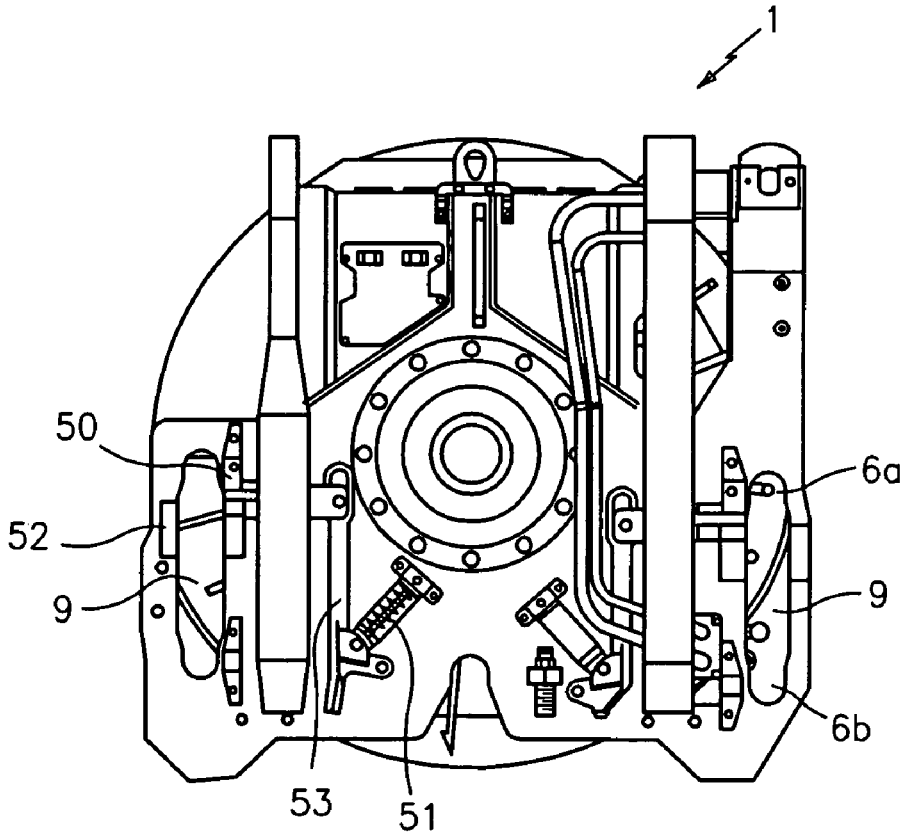
FIG. 4: shows the embodiment of the winch of the invention in a side view.

In FIG. 4, the winch 1 of the invention now is shown in greater detail. The winch 1 includes a hydraulic motor integrated in its axis of rotation, which drives the winch. The winch is mounted on a supporting frame, which includes the two parallel oblong holes 9 for bolting to the rotary platform frame 4. The oblong holes 9 have a lower bolting position 6*b*, in which the bolts 6 are in the operating position, and an upper bolt position 6*a*, in which the bolts are in the transport position. When the winch 1 in the operating position now rests on the seats 8 of the pallet 10 via the counterelements 7, the bolts 6 in the bolt position 6*b* now prevent an upward and lateral movement of the winch and hence a tilting of the winch. On the other hand, when the pallet 10 is let down, the winch 1 moves downwards until the oblong holes 9 rest on the bolts 6 in the bolt positions 6*a*. In this transport position, the winch 1 is locked via the latches 50, wherein the latches 50 are moved via a bolting drive 51 and a drive lever 53. There is provided a control surface 52 of the bolting unit, which is engaged by a counterelement on the pallet 10, so that the winch 1 is automatically locked in the transport position, when the pallet 10 is let down further, and otherwise is unlocked again automatically when the winch 1 is raised via the pallet 10.

Figure 5:
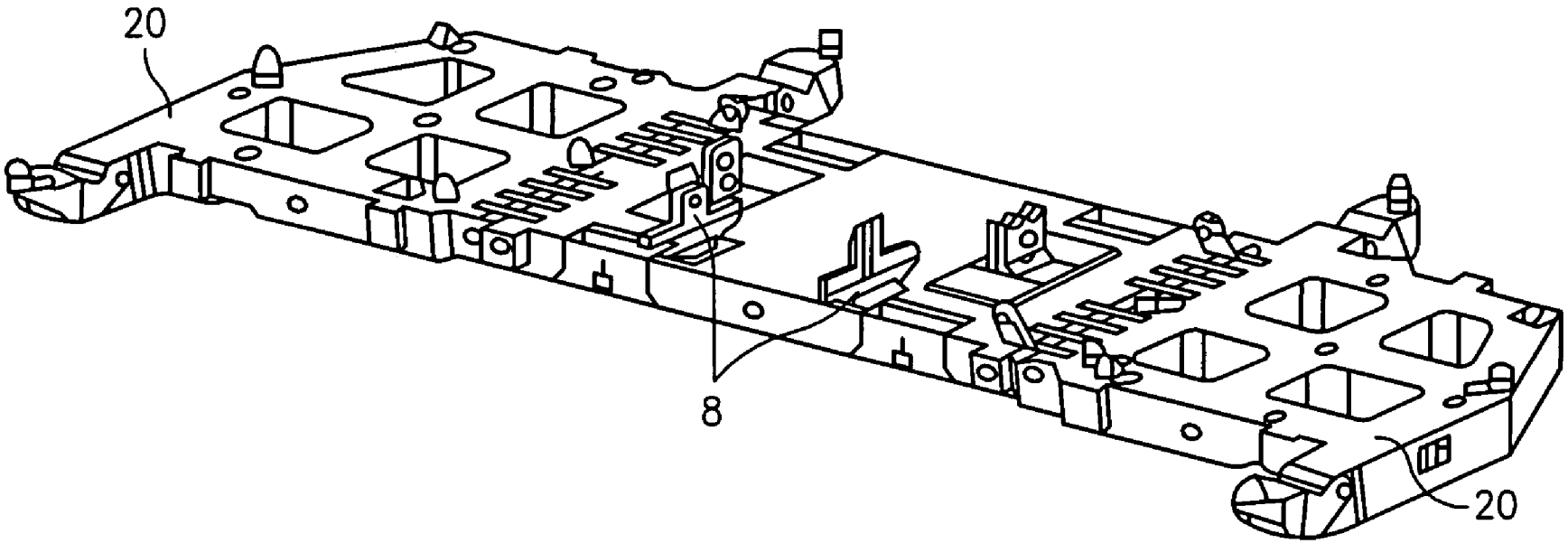
FIG. 5: shows an embodiment of the pallet of the invention for raising and/or lowering the winch.

In FIG. 5, the pallet 10 is again shown in a perspective view, wherein the seats 8 for the winch are shown in the middle region and ballast platforms 20 for accommodating ballast elements are shown in the edge portions on both sides.

Figure 3:
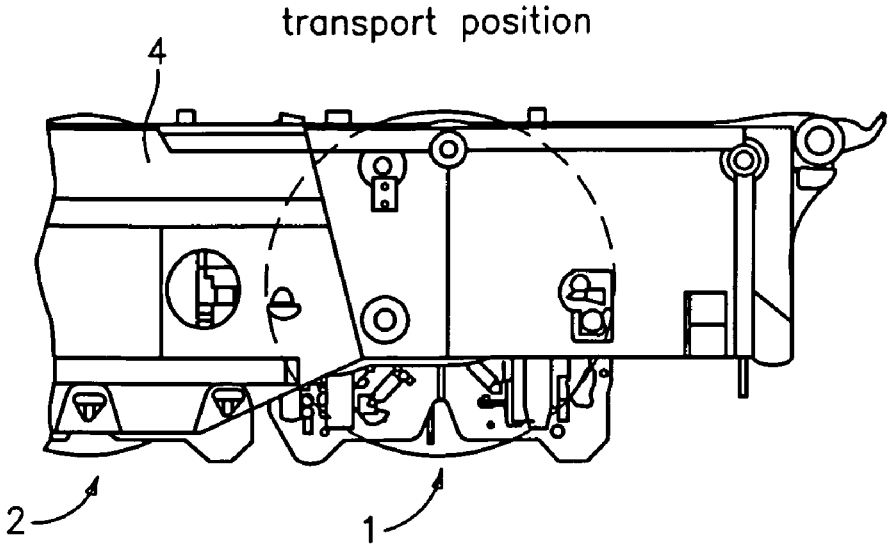
FIG. 3: shows a further side view of the winch of the invention in a transport position.

The use of the truck crane of the invention will now again be explained in detail in context: In the working condition of the truck crane, the boom can strongly be luffed down, and in this flat position all hoisting cables must be guided from the hoisting winches, in this case from winch 1 and winch 2, to the tip of the boom. In this embodiment, merely the front winch 2 is shown in FIG. 3, wherein the rear winch 1 must be positioned at a higher level in its working position. This is shown e.g. in FIG. 2*a*, in which the winch 1 is shown in its operating position on the rotary platform frame 4. As a result, however, the height permitted by the Federal Motor Vehicle Safety Standards can be exceeded.

In order to not to have to use an auxiliary crane for mounting or demounting the winch 1, the truck crane in accordance with the invention is equipped with the means for raising and/or lowering the winch 1. The means for raising and/or lowering the winch comprise a pallet 10, which in the embodiment can be raised or lowered with respect to the rotary platform frame 4 of the uppercarriage by means of cables 11. In an alternative embodiment, one or more further winches can possibly be provided, which can be raised and/or lowered by the means for raising and/or lowering the winches.

On the other hand, the front winch 2 as shown in FIG. 3 cannot automatically be raised or lowered in this embodiment due to the position of the pallet 10. However, it is in any case arranged at a lower level than the rear winch 1 in its operating position, so that it need not be lowered for transport.

The winch 1 now is configured such that by means of an auxiliary crane it can both be inserted into the rotary platform frame 4 from above and can be lifted into the rotary platform frame 4 from below. For this purpose, adjustable seats 8 are provided on the pallet 10, on which the winches can be deposited and be positioned in a defined way. A further attachment is not necessary here. Upon raising the pallet 10 into the intended bolting position on the rotary platform frame 4 as known from DE 20 2005 016 815 U1, the winches then are also arranged in their bolting positions. For this purpose, bolts 6 are provided, which can be plugged into the bolting position of the winch 1, so that the crane can adequately operate. To ensure that bolting can be effected from a safe footing, a linkage 3 is provided, by means of which bolting the winch in its working position is possible from the upper surface of the rotary platform frame 4.

When the crane need not be moved, the pallet 10 with the ballast can be let down and be removed from the crane. As a result, however, the lower bearing of the winch 1 is removed. Since the winch 1 remains bolted to the rotary platform frame 4 and the bolts 6 on the winch are accommodated in the oblong hole 9, the winch is lowered by a defined distance (length of oblong hole). As a result, the maximum admissible height according to the Federal Motor Vehicle Safety Standards is reached.

To ensure that the crane can load the ballast plates and the pallet 10 independently and without auxiliary crane, it is necessary that the lowered winch 1 remains operable. For this purpose, a latch 50 is moved forward, which retains the winch 1 in the lowered position. Thus, the crane can also operate with restricted load capacity without counterweights. The control of the latches 50 is effected automatically via a drive 51 (spring, electric or hydraulic or other type of motor, etc.) and a control. In the embodiment, a linkage is provided, which moves the latch 50 forward automatically when lifting the winch 1 from the pallet 10.

Consequently, the use of an auxiliary crane is not necessary either when newly mounting on the new construction site. When newly mounting the pallet 10, the latch 50 is moved back again automatically, since the pallet 10 engages the control surface 52 of the bolting unit, before the pallet 10 raises the winch 1.

In accordance with the invention, it is thus possible with a minimum additional constructive effort to independently accomplish the operability of the truck crane of the invention on the construction site without an auxiliary crane and at the same time comply with the transport regulations in terms of the maximum admissible height and the axle loads of the truck crane.

The invention claimed is:

1. A truck crane with a winch (1), which is mounted on an uppercarriage, wherein the truck crane includes means (10, 11) for raising and/or lowering the winch (1), the winch (1) is releasably connectable with the truck crane to be removed and then be mounted again by the means (10, 11) for raising and/or lowering the winch (1), and the winch (1) is liftable into a rotary platform frame (4) of the uppercarriage from below by the means (10, 11) for raising and/or lowering the winch (1).

2. The truck crane according to claim 1, wherein the winch (1) is also insertable into the rotary platform frame (4) of the uppercarriage from above by an auxiliary crane.

3. The truck crane according to claim 1, wherein the winch (1) is movable by the means (10, 11) for raising and/or lowering the winch (1) on the uppercarriage from a first position into an operating position located at a higher level with respect to the height direction of the truck crane and/or from an operating position into a first position located at a lower level with respect to the height direction of the truck crane.

4. The truck crane according to claim 3, wherein the first position is a transport position of the winch (1) on the crane.

5. The truck crane according to claim 3, wherein the first position is a further operating position, which permits an operation of the truck crane without ballast.

6. The truck crane according to claim 3, wherein the winch (1) is lockable in the first position via a latch (50) which fixes a bolt (6) in an oblong hole (9) such that the truck crane is also operable with the winch (1) disposed in the first position.

7. The truck crane according to claim 6, wherein locking the winch (1) in the first position is effected automatically.

8. The truck crane according to claim 6, wherein the locking of the winch (1) is released automatically when it is raised into the operating position.

9. The truck crane according to claim 1, comprising a device for accommodating a ballast, which at the same time forms the means (10, 11) for raising and/or lowering the winch (1).

10. The truck crane according to claim 1, wherein the means (10, 11) for raising and/or lowering the winch (1) comprise a pallet (10), which is movable in a vertical direction by hoisting means (11), wherein the winch (1) and/or a ballast can be moved into an operating position by the pallet (10).

11. The truck crane according to claim 10, wherein the pallet is boltable to the uppercarriage in the operating position.

12. The truck crane according to claim 10, wherein the pallet (10) includes adjustable seats (8) on which the winch (1) is erectable and positioned in a defined way.

13. The truck crane according to claim 1, wherein the winch (1) is boltable to the uppercarriage.

14. A truck crane with a winch (1), which is mounted on a uppercarriage, wherein the truck crane includes means (10, 11) for raising and/or lowering the winch (1), the means (10, 11) for raising and/or lowering the winch (1) comprise a pallet (10), which is movable in a vertical direction by hoisting means (11), the winch (1) and/or a ballast is movable into an operating position by the pallet (10), and the winch (1) rests on the pallet (10) bolted to the uppercarriage in the operating position.

15. A truck crane with a winch (1), which is mounted on a uppercarriage, wherein the truck crane includes means (10, 11) for raising and/or lowering the winch (1), the winch (1) is boltable to the uppercarriage, and bolting the winch (1) to the uppercarriage is effected by an oblong hole (9), which allows a movement of the winch (1) from an operating position into a first transport position, which is located at a lower level with respect to the height direction of the truck crane.

16. The truck crane according to claim 15, wherein the winch (1) is lockable in the first position via a latch (50) which fixes a bolt (6) in the oblong hole (9) such that the truck crane is also operable with the winch (1) disposed in the first position.

17. A truck crane with a winch (1), which is mounted on a uppercarriage, wherein the truck crane includes means (10, 11) for raising and/or lowering the winch (1) and comprising two or more winches, which are raisable and/or lowerable by the means (10, 11) for raising and/or lowering the winch.

* * * * *